US009969072B2

(12) United States Patent
Fuenfer

(10) Patent No.: US 9,969,072 B2
(45) **Date of Patent: *May 15, 2018**

(54) HAND-HELD POWER TOOL AND PRODUCTION METHOD

(75) Inventor: Josef Fuenfer, Koenigsbrunn (DE)

(73) Assignee: Hilti Aktiengesellschaft, Schaan (LI)

( * ) Notice: Subject to any disclaimer, the term of this patent is extended or adjusted under 35 U.S.C. 154(b) by 1537 days.

This patent is subject to a terminal disclaimer.

(21) Appl. No.: 13/440,643

(22) Filed: Apr. 5, 2012

(65) Prior Publication Data

US 2012/0267138 A1 Oct. 25, 2012

(30) Foreign Application Priority Data

Apr. 19, 2011 (DE) ..... 10 2011 007 660

(51) Int. Cl.

| | |
|---|---|
| ***B25D 9/00*** | (2006.01) |
| ***B25D 11/00*** | (2006.01) |
| ***B25D 13/00*** | (2006.01) |
| ***E21B 1/00*** | (2006.01) |
| ***B25D 17/06*** | (2006.01) |
| ***B21C 37/08*** | (2006.01) |
| ***B21C 37/15*** | (2006.01) |
| ***B21C 37/30*** | (2006.01) |

(52) U.S. Cl.

CPC ..... *B25D 17/06* (2013.01); *B21C 37/08* (2013.01); *B21C 37/0815* (2013.01); *B21C 37/157* (2013.01); *B21C 37/30* (2013.01); *B25D 2217/0019* (2013.01); *B25D 2250/035* (2013.01); *B25D 2250/065* (2013.01); *Y10T 29/49826* (2015.01)

(58) Field of Classification Search

CPC ..... B23B 45/00; B25D 17/06; B25D 2217/0019; B25D 2250/035; B25D 2250/065; B25D 2250/185; B25F 5/02; B25F 5/00; B29B 11/16; F16L 29/005; F16L 23/12; F16L 9/165; H02K 7/145; B21C 37/08

USPC ..... 173/1, 90

See application file for complete search history.

(56) References Cited

U.S. PATENT DOCUMENTS

| | | | | |
|---|---|---|---|---|
| 3,643,322 | A * | 2/1972 | Gerstle | 219/67 |
| 3,731,437 | A * | 5/1973 | Ewell | 451/493 |
| 3,828,415 | A * | 8/1974 | Kammeraad et al. | 29/888.41 |
| 3,994,764 | A * | 11/1976 | Wolinski | 156/218 |
| 4,103,662 | A * | 8/1978 | Kammeraad | 123/188.9 |
| 4,167,992 | A * | 9/1979 | McClellan | 188/322.12 |
| 4,186,779 | A * | 2/1980 | Wagner | 138/121 |
| 4,219,246 | A * | 8/1980 | Ladin | 384/606 |
| 4,223,196 | A * | 9/1980 | Erlandson et al. | 219/61.2 |

(Continued)

FOREIGN PATENT DOCUMENTS

| | | |
|---|---|---|
| DE | 33 07 482 | 10/1983 |
| DE | 4215288 | 1/1993 |

(Continued)

*Primary Examiner* — Robert Long

(74) *Attorney, Agent, or Firm* — Davidson, Davidson & Kappel, LLC

(57) ABSTRACT

A production method provides for punching holes in a metal strip, cold-forming the metal strip to form a guide tube, and joining the lengthwise edges of the metal strip to each other by a seam or teeth so as to create a uniform material. Subsequently, a piston-like striker is inserted into the guide tube.

9 Claims, 4 Drawing Sheets

(56) References Cited

U.S. PATENT DOCUMENTS

| | | | | |
|---|---|---|---|---|
| 4,266,578 | A * | 5/1981 | Swain et al. | 138/110 |
| 4,276,974 | A * | 7/1981 | Ladin | 192/98 |
| 4,309,815 | A * | 1/1982 | Schmitt et al. | 29/596 |
| 4,327,807 | A * | 5/1982 | Emonet | 173/207 |
| 4,365,393 | A * | 12/1982 | Hauffe et al. | 24/279 |
| 4,771,931 | A * | 9/1988 | Matsui et al. | 228/147 |
| 5,285,864 | A * | 2/1994 | Martin et al. | 180/417 |
| 5,373,905 | A | 12/1994 | Bleicher et al. | 173/109 |
| 5,375,854 | A * | 12/1994 | Carlisle et al. | 277/377 |
| 5,423,579 | A * | 6/1995 | Blose et al. | 285/334 |
| 5,426,337 | A * | 6/1995 | Kobayashi et al. | 310/89 |
| 5,465,759 | A * | 11/1995 | Carlson et al. | 138/110 |
| 5,853,200 | A * | 12/1998 | Zieres | 285/45 |
| 5,873,418 | A | 2/1999 | Arakawa et al. | 173/212 |
| 6,067,712 | A * | 5/2000 | Randlett et al. | 29/890.053 |
| 6,085,394 | A * | 7/2000 | Hartman | 24/16 PB |
| 6,254,146 | B1 * | 7/2001 | Church | 285/334 |
| 6,518,687 | B2 * | 2/2003 | Akutsu et al. | 310/216.045 |
| 6,522,041 | B1 * | 2/2003 | Verbrugge et al. | 310/154.01 |
| 6,522,042 | B1 * | 2/2003 | Du et al. | 310/154.03 |
| 6,804,874 | B2 * | 10/2004 | Niimi et al. | 29/596 |
| 6,981,302 | B1 * | 1/2006 | Breese et al. | 29/407.07 |
| 7,088,024 | B2 * | 8/2006 | Agnes et al. | 310/154.12 |
| 7,694,408 | B2 * | 4/2010 | Kitou et al. | 29/596 |
| 2002/0157235 | A1 * | 10/2002 | Napolitano et al. | 29/505 |
| 2003/0111889 | A1 * | 6/2003 | Meshke et al. | 297/391 |
| 2003/0217844 | A1 * | 11/2003 | Moyes | 166/118 |
| 2004/0035486 | A1 * | 2/2004 | Picco et al. | 138/142 |
| 2004/0104636 | A1 * | 6/2004 | Ortt et al. | 310/154.08 |
| 2004/0148992 | A1 * | 8/2004 | Huang | 72/51 |
| 2004/0177981 | A1 * | 9/2004 | Berger | 173/201 |
| 2006/0076154 | A1 * | 4/2006 | Aoki | 173/212 |
| 2007/0207186 | A1 * | 9/2007 | Scanlon et al. | 424/424 |
| 2010/0025061 | A1 * | 2/2010 | Meixner et al. | 173/118 |
| 2010/0300718 | A1 * | 12/2010 | Hartmann et al. | 173/201 |
| 2011/0000696 | A1 * | 1/2011 | Lau | 173/217 |
| 2012/0118597 | A1 * | 5/2012 | Hauptmann et al. | 173/126 |
| 2013/0319712 | A1 * | 12/2013 | Massler et al. | 173/201 |

FOREIGN PATENT DOCUMENTS

| | | | | |
|---|---|---|---|---|
| DE | 19713154 | | 10/1997 | |
| DE | 199 27 510 | | 12/1999 | |
| DE | 103 218 63 | | 12/2004 | |
| DE | 10 2006 027 046 | | 11/2007 | |
| DE | 10 2009 016 047 | | 10/2010 | |
| EP | 0 067 682 | | 12/1982 | |
| FR | 2758796 | A1 * | 7/1998 | B65D 3/04 |
| GB | 2338441 | | 12/1999 | |
| JP | 404 10 16 | | 2/1992 | |

* cited by examiner

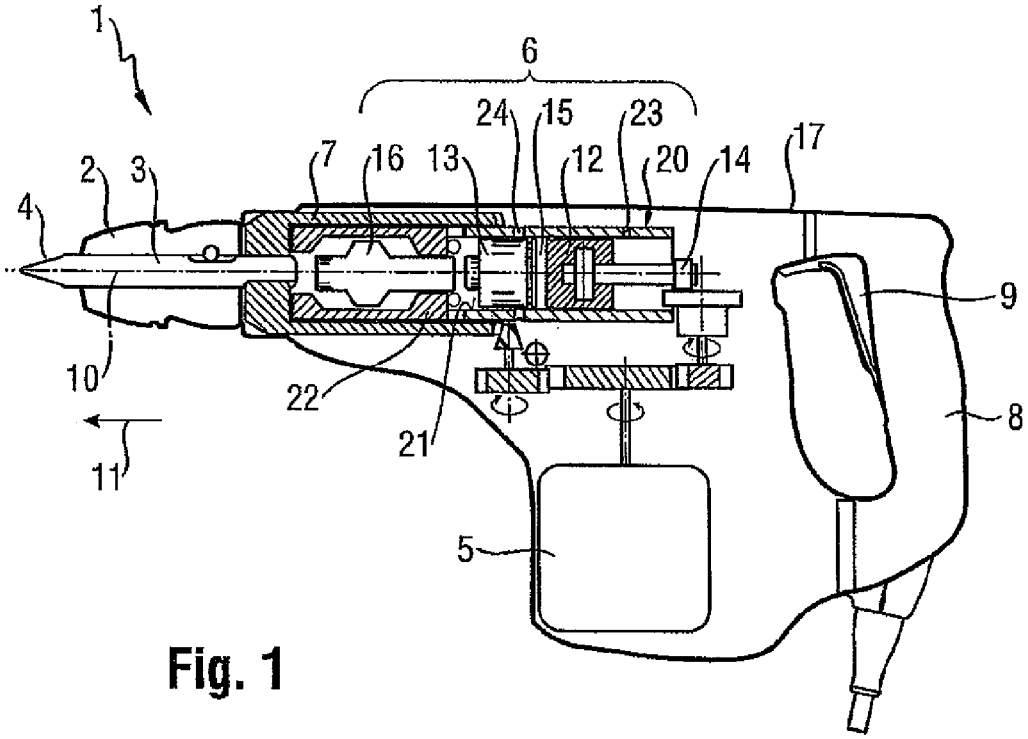
Fig. 1
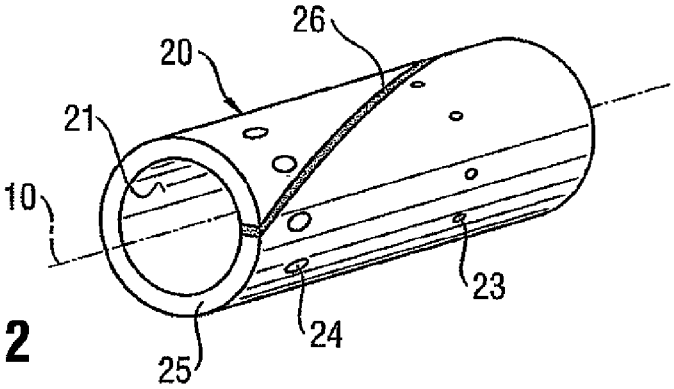
Fig. 2
Fig. 3
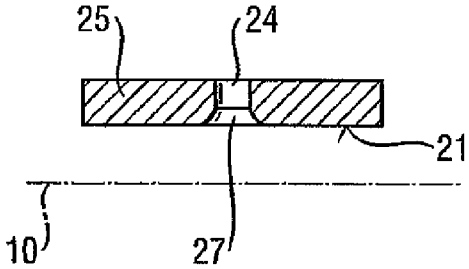

HAND-HELD POWER TOOL AND PRODUCTION METHOD

This claims the benefit of German Patent Application DE 10 2011 007 660.3, filed Apr. 19, 2011 and hereby incorporated by reference herein.

The present invention relates to a hand-held power tool, especially to a hand-held power tool with a motor-driven pneumatic striking mechanism. The invention also relates to a production method for the hand-held power tool.

BACKGROUND

In a motor-driven pneumatic striking mechanism, the striking piston is periodically accelerated in a guide tube by an air spring so that it strikes a tool at a front turning point. The principle of the air spring calls for an air-tight fit of the striking piston in the guide tube. It must not fail due to high mechanical loads from kickbacks or from thermo-mechanical stresses, i.e. if the striking mechanism heats up to temperatures in excess of 100° C. Furthermore, the striking piston has to move smoothly in the guide tube so that it does not suppress the relatively weak coupling of the motor drive via the air spring. Consequently, in order to safeguard the mechanical and thermo-mechanical properties, the guide tube is made out of a solid cylinder or out of a pipe having a small inner diameter by means of a metal-cutting procedure.

SUMMARY OF THE INVENTION

The pneumatic striking mechanism requires ventilation openings in the guide tube whose diameters are prescribed with small tolerances. The openings are drilled into the guide tube. The sharp edges that are formed on the inside in this process have to be deburred and honed so as to prevent damage to the gaskets installed on the striking piston. Since the inside is difficult to access, the deburring and honing are carried out mechanically and chemically in a laborious process.

It is an object of the present invention to allow the openings to be made in the guide tube without a need for substantial finishing steps such as honing or deburring, etc. The production method calls for making holes in a metal strip, cold-forming the metal strip to form a guide tube, and joining the lengthwise edges of the metal strip to each other by means of a seam so as to create a uniform material, and/or by joining them with teeth that intermesh. Subsequently, a piston-like striker is inserted into the guide tube. The method according to the invention goes against the preconceived notion that the guide tube has to be made from a solid body by means of a metal-cutting procedure.

A punching stamp can be placed onto a first side of the metal strip in order to punch the holes. The first side is used to create the inside of the tube. In a simple manner, the punching indentation on the first side ensures a rounded-off edge of the hole. During the punching, an indentation can be formed around the hole, the so-called draw-in, which is often undesirable and is thus prevented by suitable measures. It has been recognized that, for this application, the indentation can be advantageous since, without additional processing steps, it allows the production of a hole whose edges are not sharp.

In one embodiment, the tube that is closed with a seam is pulled over a calibration piston whose circumference is between 0.5% and 2% larger than the width of a previously bent metal strip. The circumference of the bent tube is preferably slightly smaller than the diameter required for the final guide tube. The calibration piston brings about a radial expansion of the tube which, in addition to providing an adaptation to the circular shape and the required diameter, also causes a stiffening of the tube as a result of the stretching of the material.

The present invention provides a hand-held power tool that has a pneumatic striking mechanism. The striking mechanism comprises a motor-driven exciter, a guide tube and a piston-shaped striker. The piston-shaped striker passes through the inside of the guide tube and, with the exciter, closes off an air spring in the guide tube. The exciter can likewise be piston-shaped and be located in the guide tube, being positioned against its inside. Another embodiment provides for a pot-shaped exciter, that is to say, the guide tube is rigidly connected to the exciter. The striker moves in the tubular section of the exciter that is formed by the guide tube. The guide tube is made of a metal strip that has been bent to form a tube. Two opposite lengthwise edges of the metal strip are joined by a seam and by a positive fit in the circumferential direction. The seam can be wound helically around the working axis. It can be seen in this case that the guide tube acquires increased dimensional stability.

BRIEF DESCRIPTION OF THE DRAWINGS

The description that follows explains the invention on the basis of figures and embodiments provided by way of examples. The figures show the following:

FIG. 1 a hand-held power tool;

FIG. 2 a guide tube;

FIG. 3 a detailed view of the guide tube in a lengthwise section;

Unless otherwise indicated, the same or functionally equivalent elements are designated by the same reference numerals in the figures.

DETAILED DESCRIPTION

Figure 4:
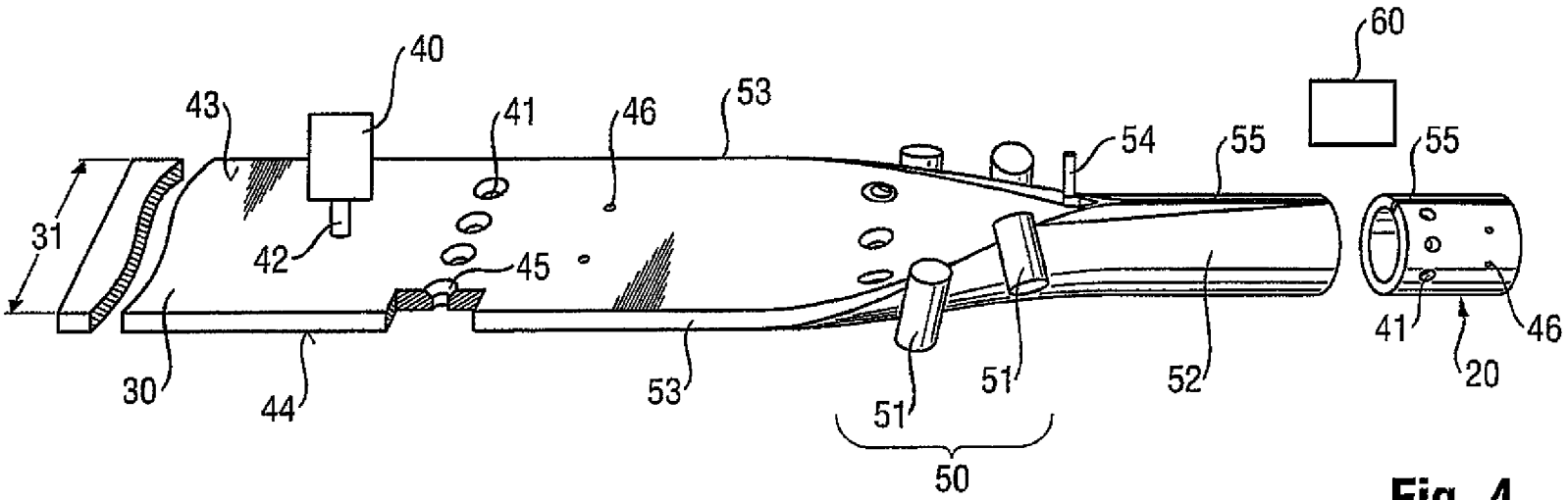
FIG. 4 a production line for the guide tube.

FIG. 1 schematically shows a hammer drill 1 as an example of a chiseling hand-held power tool. The hammer drill 1 has a tool socket 2 into which a shank end 3 of a tool, e.g. a drill chisel 4, can be inserted. A motor 5 that drives a striking mechanism 6 and a drive shaft 7 constitutes the primary drive of the hammer drill 1. A user can handle the hammer drill 1 by means of a grip 8 and can start up the hammer drill 1 by means of a system switch 9. During operation, the hammer drill 1 continuously rotates the drill chisel 4 around a working axis 10, and in this process, it can hammer the drill chisel 4 into a substrate in the striking direction 11 along the working axis 10.

The striking mechanism 6 is a pneumatic striking mechanism 6. An exciter 12 and a striker 13 are installed in the striking mechanism 6 so as to be movable along the working axis 10. The exciter 12 is coupled to the motor 5 via an eccentric 14 or a toggle element, and it is forced to execute a periodic linear movement. An air spring formed by a pneumatic chamber 15 between the exciter 12 and the striker 13 couples a movement of the striker 13 to the movement of the exciter 12. The striker 13 can strike a rear end of the drill chisel 4 directly or it can transmit part of its pulse to the drill chisel 4 indirectly via an essentially stationary intermediate striker 16 (striking pin). The striking mechanism 6 and preferably the other drive components are arranged inside a machine housing 17.

The exciter 12 shown here by way of an example is configured as a piston that is moved back and forth in the cylindrical guide tube 20. The radial outer surfaces of the exciter 12 as well as of the striker 13 seal an inner surface 21 of the guide tube 20 air-tight. The guide tube 20 can extend all the way to a bearing block 22 for the intermediate striker 16. The guide tube 20 has several openings that are radial to the working axis 10. The first set of openings 23 permits an adiabatic pressure compensation of the air spring when the device warms up. The second set of openings 24 ventilates the pneumatic chamber 15 and deactivates the air spring as soon as the striking mechanism 6 makes an empty strike.

The guide tube 20 is made of a bent metal strip 25 that is sealed with a welded seam 26 along the working axis 10 (FIG. 2). The openings 23, 24 are, for example, punched into the metal strip 25. On the inside 21 of the guide tube 20, there is preferably a punching indentation 27 (FIG. 3). The funnel-shaped widening of the opening 23, 24 that can be formed during the punching procedure causes the hole to have a smooth edge. Normally, an attempt is made during punching to avoid a punching indentation, but in this particular application, preference is given to a poorly cutting punching tool. The punching tool is preferably positioned on the side of the metal strip 25 that will later become the inside 21 of the guide tube 20. Instead of punching, the openings can also be drilled; a countersink drill or a deburring blade can create a funnel-shaped widening similar to a punching indentation 27.

A starting point for the production of a guide tube 20 can be a continuous metal strip 30 (FIG. 4). The width 31 of the continuous strip 30 is approximately 0.5% to 2% less than the circumference of the guide tube 20 that is to be produced. Preferred materials for the continuous strip 30 are soft grades of steel with a low carbon content such as spring steel, for example, with a carbon content of less than 1% by weight.

The continuous strip 30 is fed to a punch 40 that punches holes 41 into the continuous strip 30. The punch 40 presses a stamp 42 or several stamps from the first side 43 of the continuous strip 30 through to the opposite side 44. A punching indentation 45 is an approximately funnel-shaped recess in the material of the continuous strip 30 that is formed when the stamp 42 is pushed through. Preferably, a first row of first holes 41 having a first diameter is punched alternately with a second row of second holes 46 having a second diameter. The holes 41, 46 of a row are arranged essentially on a line perpendicular to the lengthwise direction of the continuous strip 30. The first diameter is greater than 3 mm, for example, greater than 5 mm, and up to 15 mm in size, for example, 10 mm in size. In the first row, for example, there can be between 4 and 10 holes. The second diameter is much smaller, for example, smaller than 1 mm. Moreover, preferably, only one or two second holes 46 are present in the second row.

A shaper or shaping means 50 with a plurality of rollers 51 rolls the continuous strip 30 in several stages to form a continuous tube 52. In this process, the first side 43 with the punching indentation 45 comes to lie on the inside of the tube 52. The edges 53 of the continuous strip 30, which are opposite from each other after the shaping procedure, are welded together. The welding can be carried out, for example, by means of induction. An appropriate welding probe 54 can be held in the area where the two edges 53 start to touch each other. The welding forms a seam 55 that joins the two edges 53 together airtight and so as to create a uniform material.

The continuous tube 52 is cut into individual guide tubes 20 by a cutting device 60. The guide tube 20 is slid one or more times over a calibration cylinder 70 or over a calibration cone, thus being widened to the desired circumference. The circumference of the calibration cylinder 70 is preferably perfectly circular and slightly larger than the inner circumference of the continuous tube. Subsequently, the exciter piston 12 and the striking piston 13 are inserted into the guide tube 20.

Figure 6:
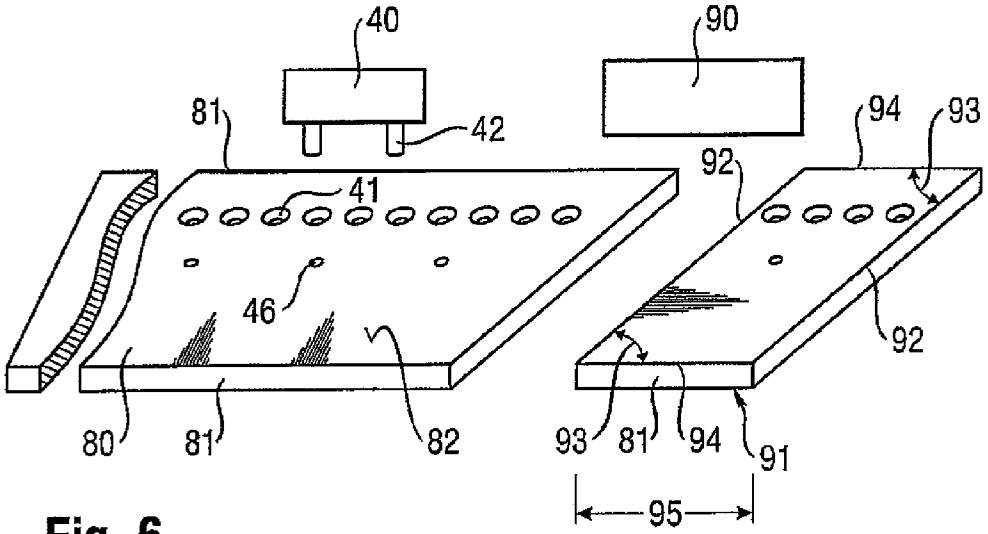

Another production method starts with the continuous strip 80 whose width corresponds, for example, approximately to the length of the guide tube 20 (FIG. 6). Two rows of holes 41, 46 are punched parallel to the edges 81 of the continuous strip 80. The characteristics of the first holes 41 and of the second holes 46 are selected to be the same as in the preceding production method. The punching indentation 45 is on a first side 82 of the continuous strip 80 for all of the holes 41.

Figure 7:
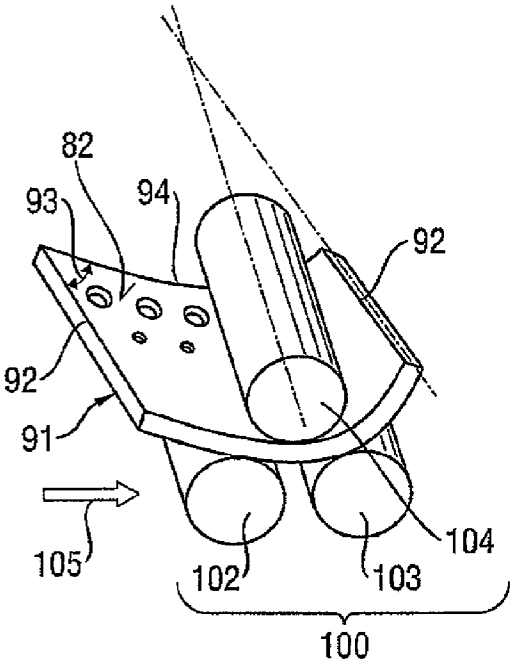
FIGS. 6 and 7 a production line for a guide tube.
Figure 8:
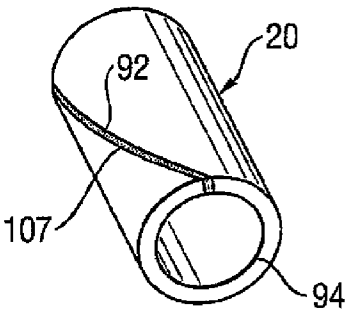
FIG. 8 a guide tube.

A cutting device 90 cuts the continuous strip 80 into metal strips 91. The metal strips 91 can be in the shape of a non-rectangular parallelogram. The longer edges 92 can be slanted at an angle 93 of less than 90°, for example, between 45° and 80°, with respect to the shorter edges 94. The length 95 of the shorter edges 94 is less than the circumference of the guide tube 20 that is to be manufactured, preferably between 0.5% and 2%. A roller bending device 100 rolls the metal strip 91 to form a tube 101 (FIG. 7). The roller bending device 100 has, for instance, two parallel guide rollers 102, 103 on which the second side of the metal strip 91 rests. A top roller 104 is arranged along a indentation direction 105 between the guide rollers 102, 103 and presses the first side 106 of the metal strip 91 in the direction of the two guide rollers 102, 103. The engagement of the upper roller 104 between the two guide rollers 102, 103 is set in accordance with the required radius of curvature or diameter of the guide tube 20. The metal strip 91 is placed into the roller bending device 100 with its shorter edges 94 parallel to the indentation direction 105. The preferably slanted, longer edges 92 touch each other after the bending procedure. Subsequently, the longer edges 92 are joined by a seam 107, for example, welded or glued (FIG. 8). The seam 107 can be spiral in shape.

Figure 5:
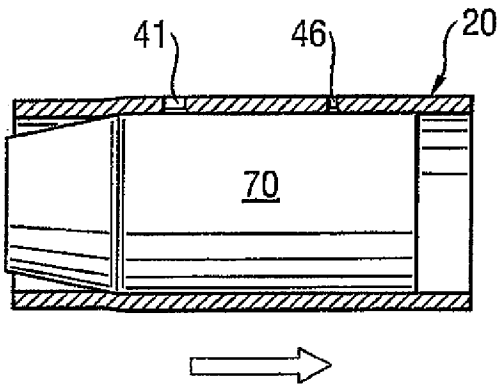
FIG. 5 a calibration of the guide tube.

Subsequently, the circumference of the bent tube is trimmed by the calibration cylinder 70 (see FIG. 5).

Figure 9:
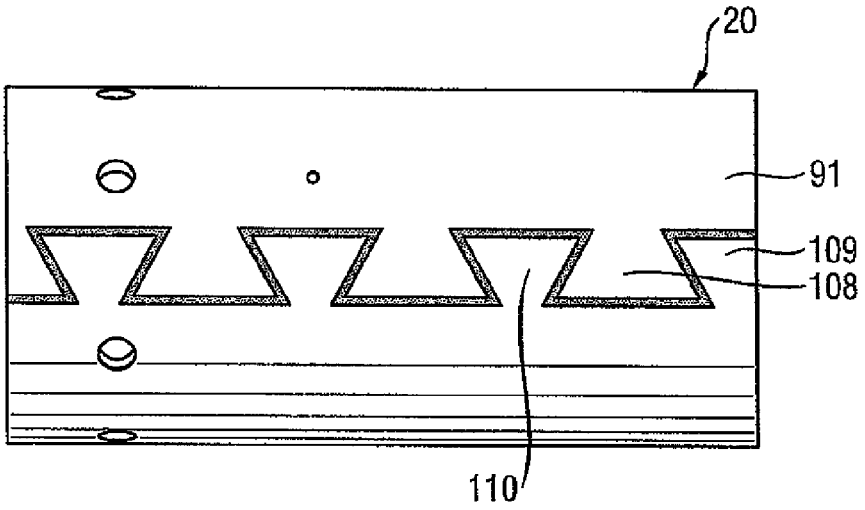
FIG. 9 a guide tube.

The metal strips 91 can be provided with first set of teeth 108 on one of the longer edges 94 and with second set of teeth 109 on the other of the longer edges 94. The sets of teeth 108, 109 can be punched in the metal strips 91, or they can be created during the cutting by the cutting device 90. The first set of teeth 108 is configured so as to intermesh with the second set of teeth 109. Preferably, the teeth 110 widen towards the edge. When the metal strip 91 is bent to form the tube 20, the two sets of teeth 108, 109 engage with each other (FIG. 9). The widening teeth 110 of the first set of teeth 108 can extend behind the second set of teeth 109. This results in a positive fit in the circumferential direction that mechanically stabilizes the tube. The positive fit that extends behind the second set of teeth allows the tube 20 to be closed in the radial direction. The sets of teeth can additionally be sealed airtight by means of welding, soldering or gluing. The tube can be trimmed by the calibration cylinder 70. A set of teeth can be stamped or embossed in the edges 53 by the method described in conjunction with FIG. 4.

The ventilation openings can be drilled into the metal strip by means of a drill before the metal strip is bent to form the tube. Preferably, the drill is positioned on the side of the metal strip that becomes the inside of the tube when it is bent. A deburring drill or a countersink drill can be used to round off the edge of the hole.

What is claimed is:

1. A hand-held power tool with a pneumatic striking mechanism comprising:

a motor-driven exciter;

a guide tube having an inside; and a piston-shaped striker, the piston-shaped striker passing through the inside of the guide tube and, with the exciter, delimiting an air spring in the guide tube, the guide tube being made of a metal strip bent to form the guide tube with opposite lengthwise edges joined by at least one of a seam and a positive fit created by teeth, the striker guided by the inside of the guide tube so as to be in contact with the guide tube in a radial direction.

2. The hand-held power tool as recited in claim 1 wherein the seam is wound helically around a working axis of the guide tube.

3. The hand-held power tool as recited in claim 1 wherein the guide tube has punched ventilation openings.

4. The hand-held power tool as recited in claim 3 wherein the punched ventilation openings have an indentation on the inside of the guide tube.

5. The hand-held power tool as recited in claim 1 wherein the guide tube has a first set of openings having a first diameter, and a second set of openings having a second diameter greater than the first diameter, the second set of openings being arranged to be offset with respect to the first set of openings in a striking direction of the pneumatic striking mechanism.

6. The hand-held power tool as recited in claim 1 wherein the metal strip is bent to form the guide tube with opposite lengthwise edges joined by the seam.

7. The hand-held power tool as recited in claim 1 wherein the metal strip is bent to form the guide tube with opposite lengthwise edges joined by the positive fit created by the teeth.

8. The hand-held power tool as recited in claim 7 wherein the teeth widen in a direction of the lengthwise edges and interlock to form the positive fit.

9. The hand-held power tool as recited in claim 7 wherein the teeth are additionally sealed by welding, soldering or gluing.

* * * * *